United States Patent [19]

Paladel

[11] Patent Number: 5,064,388

[45] Date of Patent: Nov. 12, 1991

[54] SHIELDING CHASSIS FOR PROTECTING AN ELECTRICAL CIRCUIT INSIDE SAID CHASSIS AGAINST THE EFFECTS OF ELECTROMAGNETIC RADIATION

[75] Inventor: Jean-Marie Paladel, Claix, France

[73] Assignee: Bull S.A., Paris, France

[21] Appl. No.: 584,160

[22] Filed: Sep. 18, 1990

[30] Foreign Application Priority Data

Sep. 19, 1989 [FR] France ..... 89 12287

[51] Int. Cl.[5] ..... H01R 13/648

[52] U.S. Cl. ..... 439/607; 439/559; 439/76; 174/35 C

[58] Field of Search ..... 439/86, 88, 89, 90, 439/91, 76, 607–610, 927, 931, 548, 556, 558, 559, 271; 333/12; 174/35 GC, 35 C

[56] References Cited

U.S. PATENT DOCUMENTS

| | | | |
|---|---|---|---|
| 3,366,918 | 1/1968 | Johnson et al. | 174/35 GC |
| 3,371,147 | 2/1968 | Daubenberger et al. | 174/35 GC |
| 4,349,241 | 9/1982 | Juris et al. | 439/88 |
| 4,519,664 | 5/1985 | Tillotson | 333/12 |
| 4,767,350 | 8/1988 | Cooper et al. | 439/559 |
| 4,857,668 | 8/1989 | Buonanno | 174/35 GC |
| 4,922,382 | 5/1990 | Hobbins | 174/35 GC |

*Primary Examiner*—David L. Pirlot

*Attorney, Agent, or Firm*—Weingarten, Schurgin, Gagnebin & Hayes

[57] ABSTRACT

A shielding chassis is provided with an opening to allow passage of a shielded connector part for connection to a complementary connector part disposed to confront the opening inside the shielding chassis and mounted on a circuit board. The shielding chassis is also provided with an elastic, non-metallic conducting element mounted around the opening, the conducting element contacting a shielding element of the complementary connector part, thereby allowing parasitic currents generated by electromagnetic radiation to flow to ground without passing through the interior of the chassis.

10 Claims, 4 Drawing Sheets

SHIELDING CHASSIS FOR PROTECTING AN ELECTRICAL CIRCUIT INSIDE SAID CHASSIS AGAINST THE EFFECTS OF ELECTROMAGNETIC RADIATION

FIELD OF THE INVENTION

This invention relates to a shielding chassis for protecting an electrical circuit located inside the chassis against the effects of electromagnetic radiation.

BACKGROUND OF THE INVENTION

In designing electronic equipment used for telecommunications and especially for data processing, extensive use is made of electrical devices of a more or less complex nature which, like electrical measuring recorders or electronic circuits, operated by pulses, for example, are especially sensitive to the disturbing effects caused by electromagnetic radiation generated by other electrical circuits not part of these devices. This is why each of these electrical devices, in order to be protected against the parasitic radiation, is generally located inside a metal chassis serving as both mechanical support and as shielding for the electrical device. Usually, for a variety of reasons, a single electrical device is located inside a shielding chassis. Thus, for example, a peripheral device such as a disk reader designed to be connected to a central processing and control unit, is housed in a different shielding chassis from the one in which the CPU is located. This approach allows the operator to replace the device quickly without causing a prolonged shutdown of the CPU if it becomes defective. The electrical connection between the peripheral device and the CPU is provided by a shielded conducting cable attached at one end to the electrical circuits of the device, and is provided at its other end with a shielded connector that allows the cable to be connected to the electrical circuits of the CPU. In view of the fact that the CPU usually includes one or more printed circuit boards populated with electronic components, the shielded connector is generally of the type described and shown in U.S. Pat. No. 4,337,989, the connector including a first connecting part attached to the end of the shielded conducting cable and including an insulating body provided with recesses into which contact elements of a first type (female, for example) are inserted, the elements being connected to the conductors in the cable, the insulating body being covered with a shielding element connected electrically to the shielding of the cable, and a second connector part, mounted on one of the faces of a circuit board in the CPU, including an insulating body provided with recesses into which contact elements of a second type (male, for example) are inserted, the elements being designed to contact the contact elements of the first type when these two parts of the connector are coupled together, the contact elements of the second type being connected to circuits on the circuit board. The insulating body of the second connector part, mounted on the circuit board with its coupling face perpendicular to the plane of the board, is covered on the face opposite the one in contact with the board and on its two lateral faces adjacent to its coupling face, by a metal hood overlapping the ends of the contact elements protruding from the coupling face and forming a cavity into which the first connector part can be engaged. The hood, which thus ensures proper guidance of the first connector part during engagement, likewise shields the contact elements. To this end, the hood is provided with metal feet mounted on the conducting areas provided on one of the faces of the circuit board, the conducting areas themselves being electrically grounded. When the assembly composed of the circuit board and the second connector part is placed inside a metal shielding chassis, grounding is obtained simply by connecting these conducting areas to metal parts mounted inside the chassis, provided to support the assembly. So that the first connector part at the end of the shielded conducting cable can be engaaged with the second connector part, the chassis is provided with an opening opposite the second connector part, the opening having dimensions greater than those of the first connector part, allowing the operator to couple conveniently and with no difficulty, these two parts of the connector. In addition, the metal hood covering the second connector part is also provided with elastic conducting fingers which, when the first connector part is coupled to the second connector part, come in contact with the shielding element of the first part. This being the case, it will be apparent that when these two parts of the connector are coupled together, the shielding element and the shielding of the cable are both grounded successively through the elastic fingers, the metal hood, the conducting areas on the circuit board, the metal parts holding the board to the chassis, and finally the conductors which normally ground the chassis. This procedure requires that the circuit board include, in addition to the usual conductors employed for transmitting electrical signals or for applying electrical potentials of given values, specific conducting areas to allow the shielding hood both to be mounted securely on the board and also to be connected electrically to the chassis. However, the presence of these conducting areas has the disadvantage of taking up a relatively large area on the surface of the board, thereby making it necessary either to increase the dimensions of the board considerably, or to sharply increase the density of the other conductors mounted thereon. In addition, the conducting areas located near such other conductors pose the danger of inadvertently coming in contact with them, thereby causing a short circuit. In addition, the conducting part of the circuit that includes the shielding element of the first connector part, the elastic fingers, the metal hood, the conducting areas, and the metal parts that hold the board to the chassis is essentially in the shape of a loop that is disposed almost completely contained inside the chassis. As a result, the high-frequency parasitic electric currents which originate in the cable shielding under the influence of the electromagnetic radiation that prevails outside the chassis, on passing through the conducting part as they normally go to ground, generate electromagnetic radiation the magnitude of which increases with the area of the loop formed by the conducting part and with the frequency of the parasitic currents. The electromagnetic radiation generated inside the chassis by the conducting portion therefore poses the risk of seriously disturbing the electrical circuits the chassis is supposed to protect.

SUMMARY OF THE INVENTION

A shielding chassis is disclosed that provides efficient protection against external electromagnetic radiation for an electrical circuit located inside the chassis and connected to a shielded conducting cable outside the chassis, via a connector that includes two mutually complementary parts, one shielded and attached to one end of the cable, and the other located inside the chassis and connected to the electrical circuit.

More specifically, the present invention relates to a shielding chassis designed to provide protection against external electromagnetic radiation for at least one electrical circuit located inside the chassis, the chassis being grounded and provided with at least one opening to allow passage of a first part of the shielded connector attached to one end of a shielded electrical cable to allow the first part to be coupled to a second connector part, the second part being complementary to the first part, connected to the electrical circuit, and located inside the chassis opposite the opening, wherein the chassis also includes an elastic conducting connecting element mounted on the chassis in such fashion that it is displaced by the first connecting part before the end of the movement effected by the first part as it is engaged in the opening to be connected to the second connector part, the displacement experienced by the connecting element allowing the latter to come into contact, under the influence of the elastic deformation which it undergoes, with the shielding element of the first connecting part, so that the parasitic currents induced by the electromagnetic radiation will pass directly from the shielding element to the chassis without entering the interior of the chassis. Thus, effective protection is provided even when the other connector part is itself covered by a shielding hood connected to the chassis through a portion of the circuit that extends into the interior of the chassis.

DESCRIPTION OF THE DRAWING

The invention will be more fully understood from the following detailed description, in conjunction with the accompanying figures, in which.

DETAILED DESCRIPTION OF THE INVENTION

Figure 4:
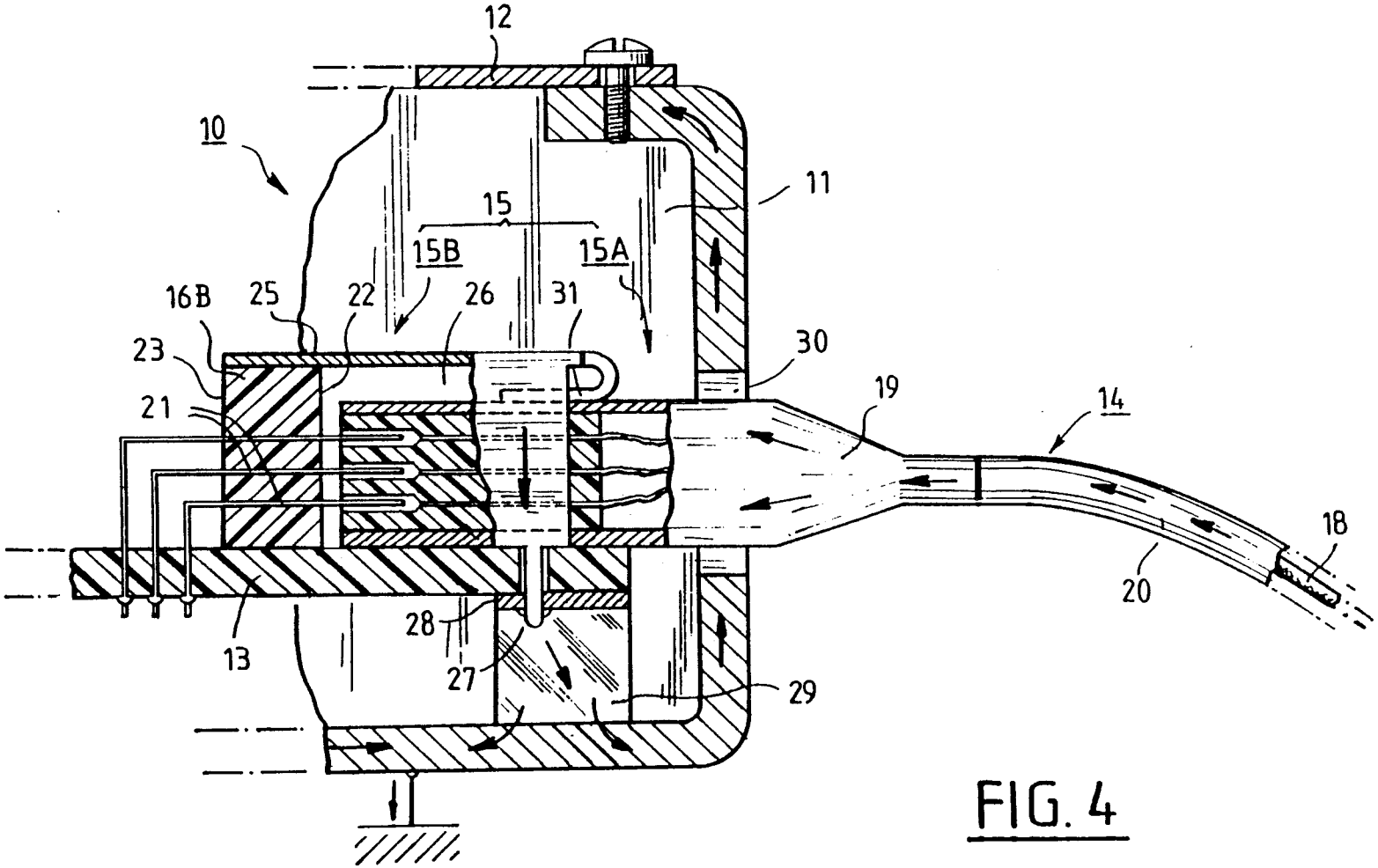
FIG. 4 is a partial cutaway view showing a shielding chassis according to the prior art, the view showing how electromagnetic radiation can be produced by a conducting portion of the circuit inside the shielding chassis.

Referring to FIG. 4, according to the prior art, an electrical circuit is protected against the effects of electromagnetic radiation by disposing it inside a shielding chassis and connecting it to a shielded electrical cable located outside the chassis via a shielded connector. A shielding chassis 10, partially shown in FIG. 4, includes a metal box 11 closed at its upper part by a removable lid 12 which can be lifted to allow access to the interior of the box. The box contains an electrical circuit which, in the embodiment shown in FIG. 4, is in the form of a printed circuit board 13 and is designed to be connected to a shielded electrical cable 14 by a shielded connector 15. As may be seen from FIG. 4, the connector 15, which is of the type described and shown in the above-mentioned U.S. Pat. No. 4,337,989, includes two parts of which one 15A is attached to one end of a shielded cable 14, and the other 15B is attached to one of the faces of the printed circuit board 13. A connector part 15A, also shown in FIG. 1, includes, as may be seen by looking at the latter figure, an insulating body 16A of parallelepipedic shape, provided with recesses into which contact elements 17 of female type are inserted, the elements being connected to electrical conductors 18 of shielded cable 14. The insulating body 16A is covered with a shielding element 19 which, as shown in FIG. 4, is in contact with the metal shielding 20 of cable 14. Connector part 15B shown in FIG. 4 includes an insulating body 16B provided with recesses into which contact elements 21 of male type are inserted, the contact elements projecting from a coupling face 22 of an insulating body 16B and being mounted so they contact element 17 of connector part 15A when these two parts are connected together. The insulating body 16B is mounted on circuit board 13 with its coupling face 22 perpendicular to the plane of the board. In the example shown in FIG. 4, circuit board 13 is mounted horizontally and consequently insulating body 16B, mounted on the upper face of the board, is located so that its coupling face 22 is vertical. Contact elements 21 pass completely through insulating body 16B and, projecting beyond face 23 of the body opposite coupling face 22, are extended by portions bent at right angles to engage holes in the board 13 and be soldered to conductors on the board. FIG. 4 also shows that insulating body 16B is covered on its upper face and on its two vertical side faces adjacent to coupling face 22 by a metal hood 25. The hood, with a cross section in the shape of an inverted U perpendicular to the plane of the figure, extends beyond the ends of contact elements 21 projecting from coupling face 22, thus defining a recess 26 designed to receive connector part 15A and ensure proper guidance of the connecting part when the latter is engaged in the recess to be coupled to connector part 15B. The hood 25 is provided at its lower part with metal feet 27 attached by screwing or soldering to conducting areas 28 of the circuit board 13, firmly attaching the hood to the board. When the assembly including circuit board 13 and connector part 15B is located inside chassis 10, these conducting areas 28 are themselves attached to metal parts 29 integral with the box 11 and provided to hold and support the device. Because the box 11 which shields the device is normally grounded, it is evident that the metal hood 25 is also grounded through the metal feet 27, conducting areas 28, metal parts 29, and the box 11. In order for the connector part 15A mounted at the end of shielded conducting cable 14 to be couplable to the connector part 15B, the box 11 is provided with an opening 30 opposite the connector part 15B. It is evident from FIG. 4 that the opening 30 has dimensions greater than those of connector part 15A so that the opening does not interfere with the passage of the connector part and allows the operator conveniently to couple the two connector parts 15A and 15B. Moreover, the continuity of the shielding between the two connector parts 15A and 15B is ensured by elastic conducting fingers that are part of metal hood 25, the fingers, one of which 31 is shown in FIG.

4, being formed on the edges of the hood near the open end of cavity 26 and folded toward the interior of the recess as shown in the figure, so that they come in contact with shielding element 19 of connector part 15A inserted into the recess. This being the case, it will be seen that when the two connector parts 15A and 15B are connected together, shielding 20 of cable 14 and shielding element 19 of part 15A will both be grounded successively through elastic the fingers 31, the metal hood 25, the feet 27, the conducting areas 28, the metal parts 29, and the box 11. However, if the box 11 and shielded cable 14 connected to the electrical circuit contained in the box are in an area of electromagnetic radiation produced by other circuits or devices located outside the box, the radiation will induce in shielding 20 of the cable, parasitic electrical currents flowing in the direction shown by the arrows in FIG. 4 as they go to ground. It is evident from FIG. 4 that these parasitic currents necessarily flow in a portion of the circuit completely inside the box 11, the circuit portion comprising the part of shielding element 19 in the box, the elastic fingers 31, the metal hood 25, the feet 27, the conducting areas 28, and the metal parts 29. The part of the circuit, when traversed by parasitic currents, thus generates electromagnetic radiation whose magnitude increases with the area of the loop formed by the part of the circuit, and with the frequency of these parasitic currents. The electromagnetic radiation generated inside the box 11 by the part of the circuit therefore poses a risk of seriously disturbing the electrical circuits on the circuit board 13.

Figure 1A:
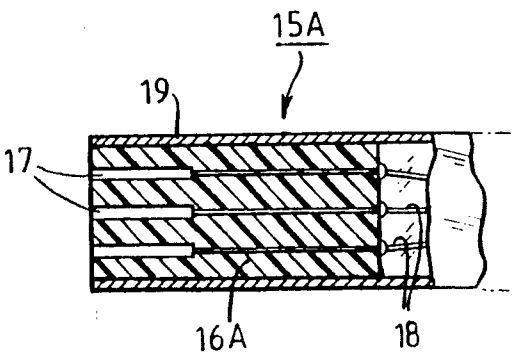
FIGS. 1 and 1A are a cross-sectional view that shows a shielding chassis according to the invention and including an electrical circuit adapted to be connected through a shielded connector to a shielded electrical cable located outside the shielding chassis.
Figure 1:
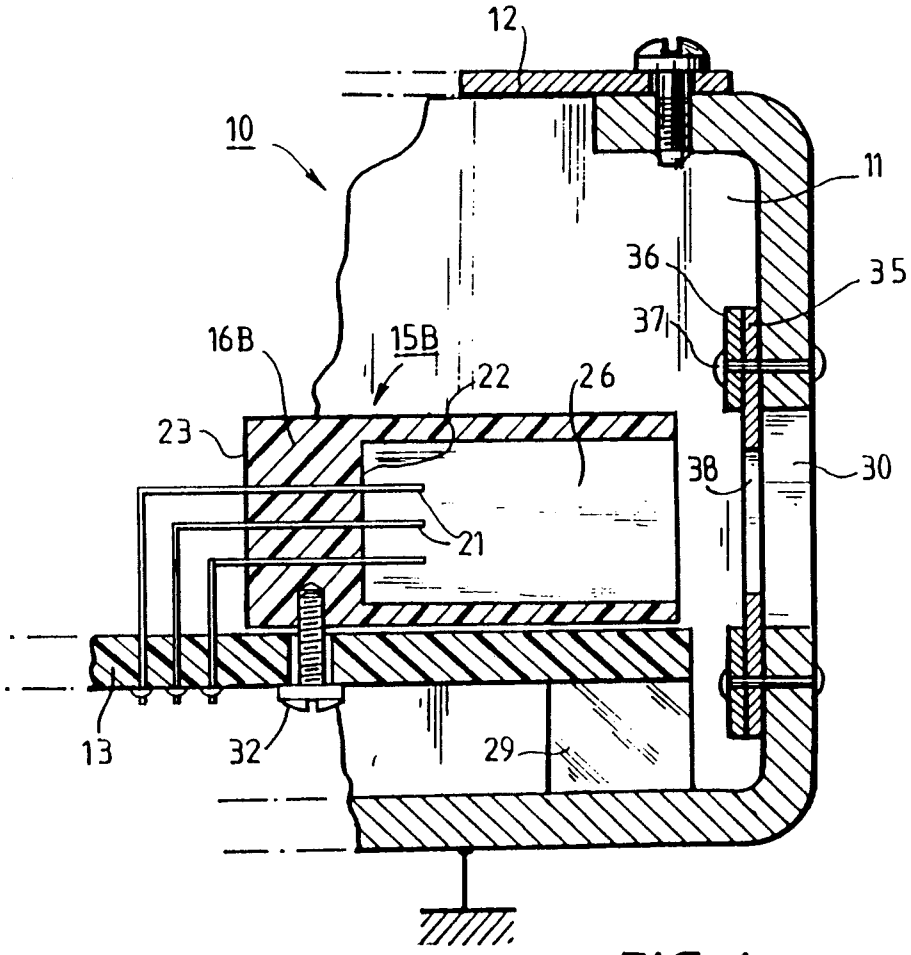

The shielding chassis of the invention does not suffer from this shortcoming. As may be seen from FIG. 1, the chassis includes a box 11 closed by a lid 12, and contains an electrical circuit formed on a circuit board 13. The circuit is connected to a shielded electrical cable (not shown) of the type shown in FIG. 4, through a connector that includes two parts, one of which 15A is attached to one end of the cable, the other 15B being mounted on the circuit board 13. Connector part 15A is analogous to that described above. In the embodiment shown in FIG. 1, the connector part 15B includes an insulating body 16B with a recess 26 dimensioned so as to allow connector part 15A to engage the recess with a small amount of play, the bottom of the recess constituting the coupling face of connector part 15B. Contact elements 21, of male type, projecting from the coupling face 22, are mounted to contact element 17 of connector part 15A when these two parts 15A and 15B are coupled together. Contact elements 21 pass completely through insulating body 16B and project from face 23 of the body opposite coupling face 22, and are extended by conducting portions bent at right angles to be connected to the conductors on the board 13. FIG. 1 shows that connector part 15B is positioned so that its recess 26 is opposite opening 30 in the box 11, the connector part being mounted on board 13 in known fashion, for example, by means of the screws 32 engaging the holes in board 13 and screwed into matching threaded holes in the insulating body 16B. Opening 30 has dimensions larger than those of the cross section of connector part 15A so that it can pass easily through the opening to be connected to the connector part 15B. This characteristic also appears in FIG. 2, where the position it occupies in opening 30 is represented by a dot-dashed line 33 in the shape of the cross section of connector part 15A when the latter is connected to connector part 15B, the line 33 being inside the outline formed by edge 34 of opening 30.

Figure 2:
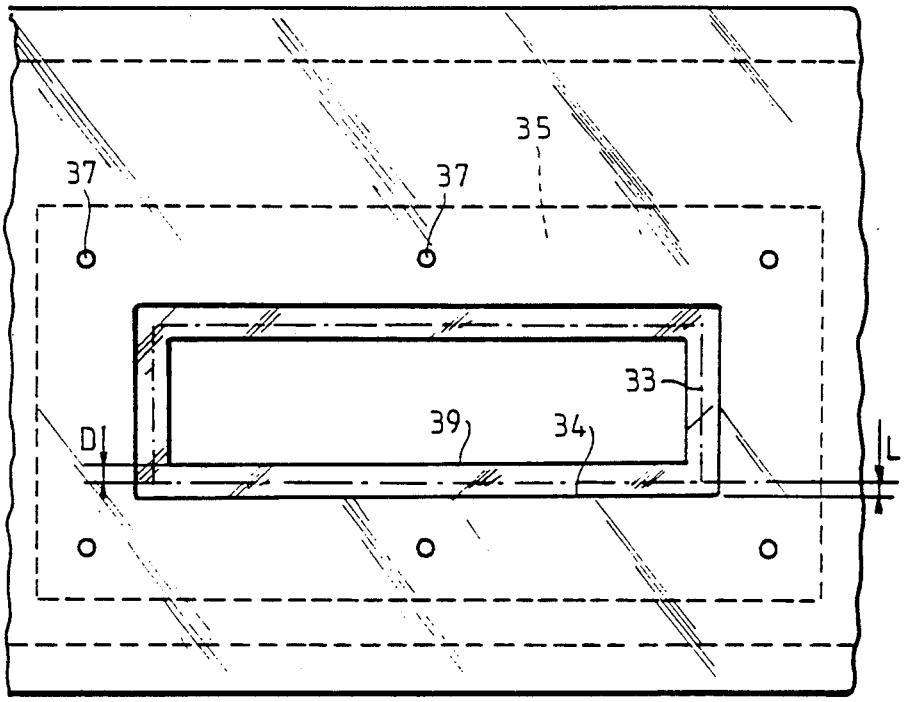
FIG. 2 is an elevation view of the shielding chassis of FIG. 1 showing the shape of the elastic conducting connecting element.
Figure 3:
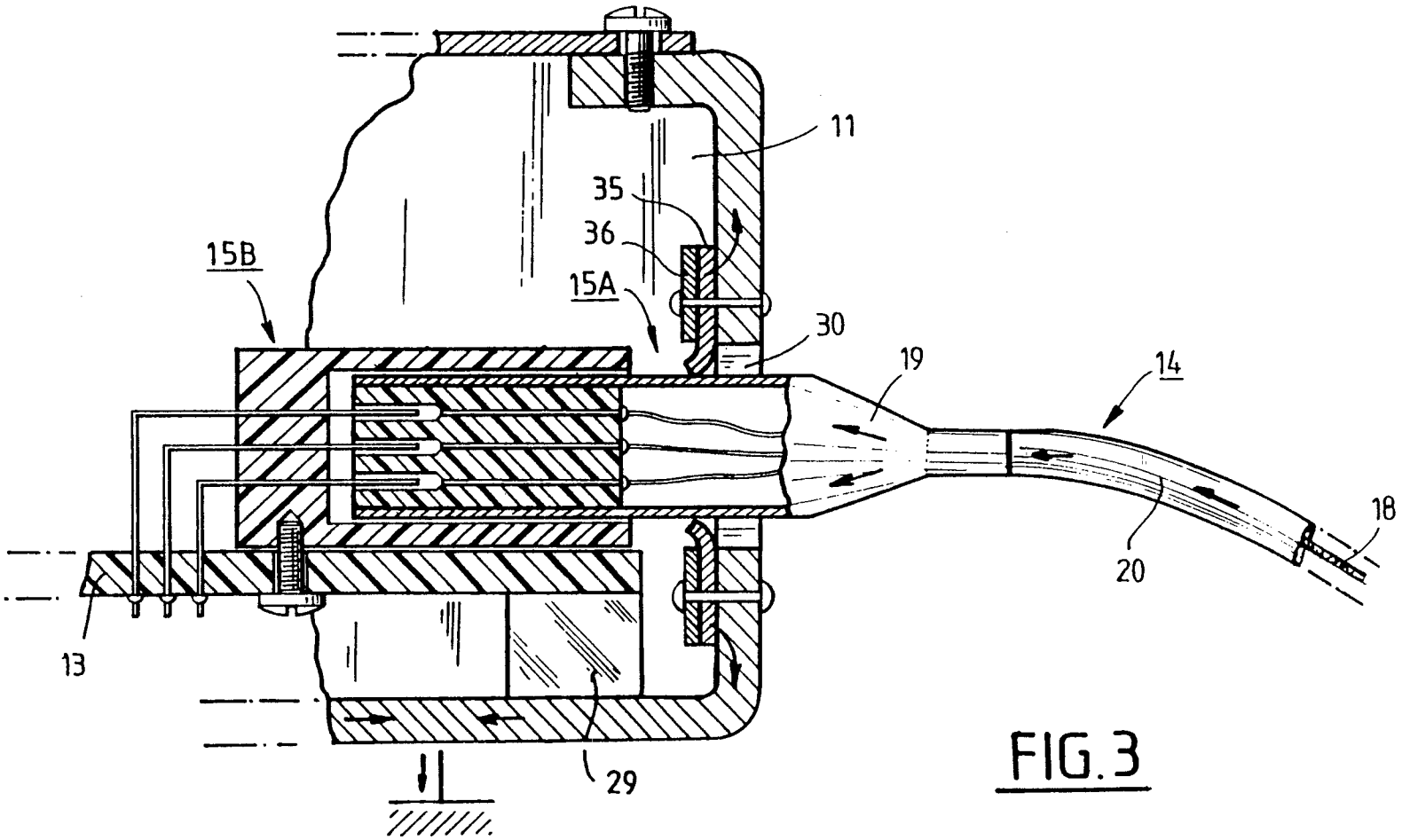
FIG. 3 is a cross-sectional view showing the position occupied by the elastic conducting connecting element of the shielding chassis when the two parts of the shielded connector are coupled together.

However, as may be seen from looking at FIGS. 1 and 2, the box 11 is provided with an elastic conducting connecting element which is nonmetallic and, in the example shown, is in the shape of a diaphragm 35, the diaphragm being mounted on the box around the opening 30 so that it comes in contact with the shielding element 19 of connector part 15A when the latter is connected to connector part 15B. In the embodiment shown in FIGS. 1 and 2, diaphragm 35 is kept in contact with the wall of the box adjacent to opening 30 by a hollow panel 36 attached to box 11 by rivets 37. The diaphragm 35 is provided with a central opening 38, which like opening 30, has a rectangular shape but has dimensions smaller than those of the cross section of connector part 15A, the opening 38 being delimited by an edge 39 located, as shown in FIG. 2, inside the outline formed by line 33 showing the position occupied in opening 30 by the cross section. This being the case, when connector part 15A is engaged in the opening 30 for coupling to connector part 15B, the portion of the diaphragm which is a round opening 38 and located on the trajectory followed by the connector part 15A is pushed toward the inside of the box by the connector part and is therefore bent. However, in view of the fact that diaphragm 35 is elastic, the portion tends to return to its original shape and consequently comes in contact as shown in FIG. 3 with shielding element 19, thus providing a pressure contact all around the shielding element, in other words, on the four faces of the element. Hence, shielding element 19 is grounded via the diaphragm 35 and the box 11. It will therefore be understood that if box 11 and the shielded cable 14 connected to the electrical circuit contained in the box are in an area where electromagnetic radiation is present, the parasitic electrical currents induced by this radiation in shielding 20 of the cable will flow as indicated by the arrows in FIG. 3, successively through shielding element 19, diaphragm 35, and box 11, finally going to ground. Hence., these parasitic currents do not circulate in any part of the circuit inside box 11 and pose no risk of generating electromagnetic radiation inside the box.

The material used to make diaphragm 35 is a nonmetallic elastic conductor, i.e., a conductor not made exclusively of metal and with much greater mechanical flexibility than that of a metal or metal alloy. The material is made of a conducting elastomer, i.e., an elastomer into which conducting metal particles have been incorporated, for example, particles of silver, gold, nickel or aluminum, with the percentage by volume of these conducting particles in the elastomer generally being between 30% and 70%. In the example described, the elastomer preferably consists of a silicone rubber charged with fine flakes or spherical granules of nickel or aluminum, the conducting elastomer exhibiting an electrical resistivity no greater than 0.2 ohm-centimeters and a breaking elongation of less than 300%. In addition, the thickness of diaphragm 35 is between 0.5 mm and 3 mm, with the preferred value being practically equal to 1 mm. It should also be pointed out that in order to facilitate the passage of connector part 15A through central opening 38 in diaphragm 35, without requiring major effort on the part of the operator, the opening 38 is dimensioned such that distance D separating its edge 39 from line 33 showing the position occupied in opening 30 by the cross section of the connector part is at most equal to 3 mm. It should also be pointed out that, as may be seen from FIG. 2, opening 30 in box 11 is so dimensioned that its edge 34, located outside the outline formed by the line 33, is a very short distance L from the outline, the distance L being at most equal to 3 mm. This being the case, the portion of diaphragm 35 between edge 34 and line 33 and traversed by parasitic electric currents flowing from shielding element 19 to box 11 has an electrical resistance R whose value is given by the familiar expression:

$$R = r(L/S)$$

where r designates the electrical resistivity of the material comprising diaphragm 35, S represents the thickness of the diaphragm multiplied by the length of line 33, the length being that of the outline of the cross section of connector part 15A. When the length of the line 33 is essentially equal to 50 mm, the resistance, using the values of r and L above, is at most equal to 0.12 ohm for a diaphragm with a thickness of 1 mm.

It should also be mentioned that although in the embodiment shown in FIGS. 1 and 3, connector part 15B has been located to prevent shielding element 19 of connector part 15A from being grounded through metal parts 29, the box 11 shown in both FIGS. 1 and 3 can also be used to protect against the effects of electromagnetic radiation on the circuits on a circuit board 13 provided with a connector part 15B similar to that shown in FIG. 4. In the latter embodiment, shielding element 19 of the connector part 15A is then connected to the box 11, both through a portion of the circuit located inside the box and including, as shown above, elastic fingers 31, metal hood 25, feet 27, conducting areas 28, and metal parts 29, and is connected through the portion of diaphragm 35 between edge 34 and line 33. It should also be mentioned that the part of the circuit inside the box, because of its relatively great length and the reduced cross section of fingers 31 and feet 27, has an electrical resistance on the order of 0.03 ohm. This portion of the circuit also exhibits impedance caused by the inductance resulting from the loop traversed by the parasitic electric currents, the impedance having a value essentially equal to 0.1 ohm when the frequency of these currents is 10 megahertz, and is equal to approximately 1 ohm when the frequency of these currents is 100 megahertz. In view of the fact that the frequency of these currents is generally greater than 10 megahertz, it is evident that this part of the circuit has a total impedance of more than 0.11 ohm. However, in this case, diaphragm 35 is made of silicone rubber charged with fine particles of nickel or aluminum and has an electrical resistivity of at most 0.01 ohm-centimeter. This being the case, the portion of diaphragm 35 between edge 34 and line 33, in view of the numerical values given above, has an electrical resistance of at most 0.006 ohm, the portion of the diaphragm therefore has an electrical impedance 1/20 that of the part of the circuit located inside the box 11. As a result, the high-frequency parasitic currents induced in the shielding of cable 14 by electromagnetic radiation outside the box 11 for all practical purposes cannot penetrate the part of the electrical circuit that includes fingers 31, hood 15, feet 27, conducting areas 28, and metal parts 29, and the parasitic currents pass mainly through diaphragm 35 to return to box 11 and then go to ground. Consequently, no electromagnetic radiation is generated inside the box 11 by these parasitic currents.

Figure 5:
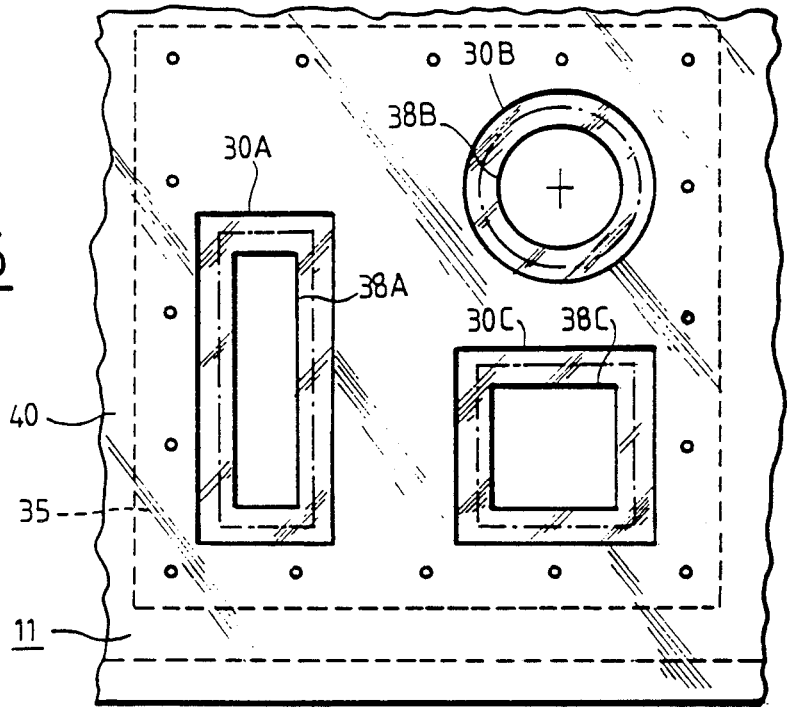
FIG. 5 is a front view showing another embodiment of the elastic conducting connecting element of the shielding chassis shown in FIG. 1.

It may be necessary to connect to the electrical circuit of the circuit board 13, not just one but a plurality of shielded electrical cables. When the connector parts attached to the ends of the electrical cables differ from one another, particularly in size and shape, it is essential for the box 11 to be provided with a plurality of openings, each provided with a passageway allowing each of these connector parts to be brought inside the box to be connected to a complementary connector part. In one especially advantageous embodiment, these openings may be located on the same face of the box. An example of this embodiment is shown in FIG. 5, with one of the panels 40 that encloses box 11 being provided with three openings 30A, 30B, and 30C, wherein one 30A is rectangular, another 30B is circular, and the last 30C is square; these three shapes correspond to the shapes of the cross sections of the connector parts designed to be fitted into these openings. When these openings are relatively close together, it may be advisable to provide for these three openings only one diaphragm 35, instead of three as before, the diaphragm 35 being made of an elastic conducting material, the diaphragm being dimensioned so that it spans all three openings when mounted on housing panel 40, the diaphragm 35 itself being provided with three openings 38A, 38B, and 38C, each centered on one of openings 30A, 30B and 30C in panel 40, in a manner similar to that shown in FIG. 2.

It should also be pointed out that because conducting diaphragm 35 has elastic properties, opening 38 in the diaphragm may be made without strict machining tolerances, the only condition required for application of the diaphragm all around shielding element 19 being that edge 39 of the opening be located inside the outline formed by line 33 indicating the position occupied in the opening by the cross section of the shielding element. Consequently, circuit board 13 may be mounted inside chassis 10 without precise positioning, provided however that the above condition is met.

Of course, the invention is not limited to the embodiments described and illustrated, provided only as examples. On the contrary, it includes all means constituting technical equivalents of those described and shown, considered separately or in combination, and utilized within the scope of the following claims.

What is claimed is:

1. A shielding chassis for shielding against electromagnetic radiation, comprising:

a metal chassis for shielding at least one electrical device and containing an opening to permit passage of an external connector;

grounding means for connecting said chassis to an electrical ground;

an elongated shielded connector member for connecting the at least one electrical device shielded in said metal chassis through said opening;

a connector member complementary to said elongated shielded connector for mating therewith, said complementary connector member being electrically connected to the at least one electrical device shielded within said metal chassis and aligned with said opening within said chassis to matably receive said elongated shielded connector placed through said opening; and an elastic conductive coupling element located adjacent said chassis hole and electrically connected to said metal chassis, said coupling element formed of an elastomer into which conducting metal particles have been incorporated and aligned to engage said elongated shielded connector member when said member is inserted into said chassis hole and to establish electrical connection therewith and between said metal chassis and said inserted connector member, whereby electromagnetic radiation arising from parasitic currents travelling through the at least one electrical device, said elongated shielded connector member, and said metal chassis is circumvented,

2. The shielding chassis of claim 1 wherein said opening in said chassis is no greater than 3 mm smaller than the cross section of said elongated shielded connector member.

3. The shielding chassis of claim 1 wherein said elastic conductive coupling element is nonmetallic.

4. The shielding chassis of claim 3 wherein said nonmetallic elastic conductive coupling element is a diaphragm comprising elastic material, wherein said diaphragm is mounted about the periphery of said opening of said chassis, and is provided with a central opening smaller than the cross section of said elongated connector member.

5. The shielding chassis of claim 4 wherein the thickness of said diaphragm is between 0.5 and 3 mm.

6. The shielding chassis of claim 4 wherein said complementary connector member is covered with a metal hood connected to said chassis and wherein said diaphragm comprises a conducting elastomer material with a thickness of at least 1 mm and an electrical resistivity of at most 0.01 ohm-centimeter.

7. The shielding chassis of claim 4 wherein said central opening in said diaphragm is smaller than the cross-section of said elongated shielded connector member.

8. The shielding chassis of claim 4 wherein said diaphragm consists essentially of a conductive elastomeric material having an electrical resistivity no greater than 0.2 ohm-centimeter.

9. The shielding chassis of claim 8 wherein the conductive elastomeric material is a silicone rubber that contains metal particles, the percentage by volume of which in said material being between 30% and 70%.

10. The shielding chassis of claim 9 wherein the conductive metal particles are fine particles of a metal selected from the group consisting of silver, gold, nickel, and aluminum.

* * * * *

UNITED STATES PATENT AND TRADEMARK OFFICE

CERTIFICATE OF CORRECTION

PATENT NO. : 5,064,388

DATED : November 12, 1991

INVENTOR(S) : Jean-Marie Paladel

It is certified that error appears in the above-identified patent and that said Letters Patent is hereby corrected as shown below:

Column 6, line 41, "ground. Hence., these parasitic" should read --ground. Hence, these parasitic--.

Column 9, line 9, "is circumvented," should read --is circumvented.--

Column 9, lines 19-20, "diaphragm comprising elastic" should read --diaphragm comprising conductive elastic--.

Column 10, line 18, "contains metal particles, the" should read --contains conductive metal particles, the--.

Signed and Sealed this

Twenty-third Day of March, 1993

*Attest:*

STEPHEN G. KUNIN

*Attesting Officer*

*Acting Commissioner of Patents and Trademarks*